US005645291A

United States Patent [19]

Ramage

[11] Patent Number: 5,645,291

[45] Date of Patent: Jul. 8, 1997

[54] ALL TERRAIN SKATEBOARD

[76] Inventor: Sandy F. Ramage, 19601 Green Mountain Dr., Newhall, Calif. 91321-2147

[21] Appl. No.: 613,495

[22] Filed: Mar. 11, 1996

[51] Int. Cl.[6] ..... B62M 1/00

[52] U.S. Cl. ..... 280/87.042; 280/11.27; 403/306; 403/307

[58] Field of Search ..... 280/87.041, 87.042, 280/11.27, 11.28, 93, 96.1, 809; 301/5.3, 108.4, 128, 132; 180/905, 906; 403/305, 306, 307, 361

[56] References Cited

U.S. PATENT DOCUMENTS

| | | | |
|---|---|---|---|
| 4,045,046 | 8/1977 | Taylor et al. | 280/87.04 A |
| 4,106,786 | 8/1978 | Talbott | 280/8 |
| 4,114,913 | 9/1978 | Newell et al. | 280/12 |
| 4,133,546 | 1/1979 | Rosenblum | 280/11.1 |
| 4,183,546 | 1/1980 | Heilig | 280/87.04 |
| 4,185,847 | 1/1980 | Johnson | 280/87.04 |
| 4,398,734 | 8/1983 | Barnard | 280/11.28 |
| 4,398,735 | 8/1983 | Evans et al. | 280/11.28 |
| 4,681,333 | 7/1987 | Rouge et al. | 280/87.04 |
| 4,718,732 | 1/1988 | Osborne | 301/36 R |
| 4,796,909 | 1/1989 | Kirkendall | 280/651 |
| 4,828,328 | 5/1989 | Bowman | 301/130 |
| 4,919,561 | 4/1990 | Kee | 403/305 |
| 5,096,225 | 3/1992 | Osawa | 280/842 |
| 5,100,161 | 3/1992 | Tillyer | 280/87.042 |
| 5,143,388 | 9/1992 | Chen | 280/11.28 |
| 5,165,708 | 11/1992 | I-Chuan | 280/11.115 |
| 5,165,710 | 11/1992 | Runyon | 280/87.042 |
| 5,169,166 | 12/1992 | Brooks | 280/87.042 |
| 5,259,632 | 11/1993 | Mahoney | 280/7.14 |
| 5,263,725 | 11/1993 | Gesmer et al. | 280/11.28 |
| 5,330,214 | 7/1994 | Brooks et al. | 280/87.042 |
| 5,372,384 | 12/1994 | Smith | 280/842 |
| 5,385,420 | 1/1995 | Newman, Sr. et al. | 403/299 |
| 5,474,314 | 12/1995 | Lehman | 280/87.042 |

OTHER PUBLICATIONS

Porges, Paul P., "Mad's Customized Skateboards", Mad Magazine, No. 189, pp. 12–13.

*Primary Examiner*—Brian L. Johnson
*Assistant Examiner*—Bridget Avery
*Attorney, Agent, or Firm*—Jack C. Munro

[57] ABSTRACT

An adapter that is to be mounted on each end of each axle of a skateboard. The adapter is to be added to the axle after the conventional wheels of the skateboard have been removed. The adapter extends the wheel mounting for the skateboard some distance from the peripheral edge of the platform of the skateboard. A substantially larger wheel can then be utilized in conjunction with the skateboard facilitating usage of the skateboard within terrain other than hard surface terrain such as grass and dirt.

3 Claims, 2 Drawing Sheets

ALL TERRAIN SKATEBOARD

BACKGROUND OF THE INVENTION

1) Field of the Invention

The field of this invention has to do with a skateboard and in particular to an adapter that is to be mounted in conjunction with the axles of the skateboard suitably modifying the skateboard to be usable with larger size wheels for use on irregular terrain.

2) Description of the Prior Art

Skateboards are commonly used for recreational purposes. A typical skateboard comprises an elongated platform supported on four wheels. The platform is located above the wheels. The skateboard user balances on the platform and adjusts the direction of travel by manipulating the pressure of his or her weight at various locations on the platform.

As the platform is located above the wheels, the wheel diameter is limited so the platform remains clear of the wheels even when the platform is tilted to different angles by imparting pressure variations on the skateboard. Therefore, the use of skateboards in the past has been limited to relatively smooth terrain due to the need to accommodate relatively small wheel size.

Skateboards are conventionally constructed with a pair of trucks attached to the underside of the elongated platform. The trucks are aligned along the center line of the platform. One truck is located adjacent the front end of the platform with the other truck being located adjacent the rear end of the platform. Each truck supports a pair of skateboard wheels. The skateboard wheels extend laterally from each other and are supported on axles. The trucks are typically screwed or otherwise fastened to the underside of the platform. The axle extends laterally outward from each side of the truck. The skateboard wheels are each independently rotatable on the axle.

Conventional skateboards have hard plastic and neoprene wheels. These types of wheels, which are generally no more than two to three inches in diameter, are commonly known to catch in cracks, on sticks, pebbles, and gravel and therefore the conventional skateboards are restricted to usage on smooth surfaces. Typical smooth surfaces are streets and sidewalks.

In the past there have been attempts at designing skateboards to be used on unpaved terrain. However, these skateboards have been of complex construction which greatly inflated the cost of manufacture. Additionally, these skateboards cause the platform on which the user stands to be raised some distance higher from the terrain. The higher the platform the less the stability of the skateboard. It is therefore desirable to have the platform as low as possible thereby keeping the center of gravity of the skateboard as low as possible to the terrain thereby increasing stability and make the riding of the skateboard as easy as possible.

SUMMARY OF THE INVENTION

The subject matter of the present invention comprises an adapter that is designed to convert any conventional skateboard into an all terrain skateboard. The existing wheels on the conventional skateboard are to be removed and on each end of each axle of the skateboard there is to be installed an adapter. This adapter will extend in essence the length of the axle 3.5 inches on each side which means that the overall width of the wheel base has been increased about 7 inches. This means that the width of the wheel base is in essence doubled when compared to a conventional skateboard. This adapter includes a through threaded opening into which the shaft of the wheel is to be secured. Also, the outer end of the axle has a threaded shaft which is to be threadably engaged with this opening. The outer end of the axle is to fit within an internal cavity of the adapter. This internal cavity will transfer the torque movement to a position substantially nearer the truck thereby minimizing the possibility of axle breakage during usage permitting the adapter to be manufactured from a metal other than steel, such as aluminum. The use of aluminum adapters is of a great benefit as the overall weight of the skateboard can be substantially lessened. The lighter the weight of the skateboard the easier the skateboard is to maneuver.

The primary objective of the present invention is to design an adapter which can be utilized in conjunction with a conventional skateboard, transforming the conventional skateboard into a recreational toy that can be usable on unpaved terrain.

Another objective of the present invention is to utilize an adapter which keeps the center of gravity of the skateboard as low as possible, thereby helping to keep the skateboard at maximum stability during usage.

Another objective of the present invention is to utilize an adapter which can be manufactured from aluminum thereby minimizing the increase in weight of the overall skateboard so as to not lose maneuverability of the skateboard due to excess weight.

Another objective of the present invention is that by use of the adapter, conventional skateboards are not restricted to a specific usage but can be expanded to be used on off-road terrain.

Another objective of the present invention would be to utilize the skateboard as an off season training device for skiers.

Another objective of the present invention is to use the skateboard of the present invention on ski slopes when there is no snow.

Another objective of the present invention is to permit installing of the skateboard trucks and adapters along with oversize wheels on a conventional snowboard providing a use for snowboards under no snow conditions.

Another objective of the present invention is to install conventional skateboard trucks and the adapter of the present invention in conjunction with oversized wheels on a wind surfing board with this modified wind surfing board to then be usable on a field or dry lake bed and not be restricted to usage only on water.

DETAILED DESCRIPTION OF THE PREFERRED EMBODIMENT

Figure 1:
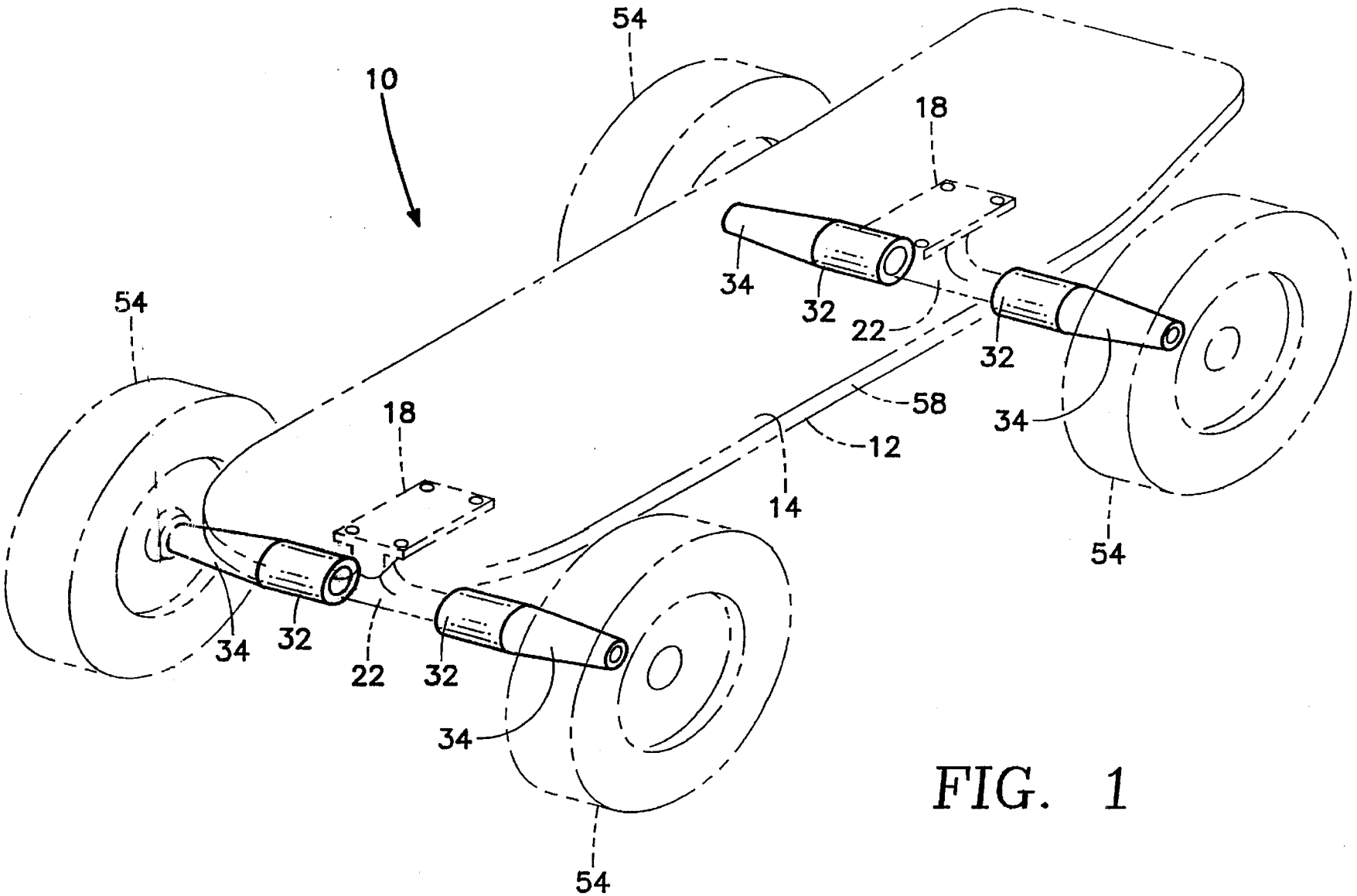
FIG. 1 is an isometric view of a conventional skateboard upon which has been installed the adapters of the present invention transforming the conventional skateboard into an all terrain skateboard.
Figure 2:
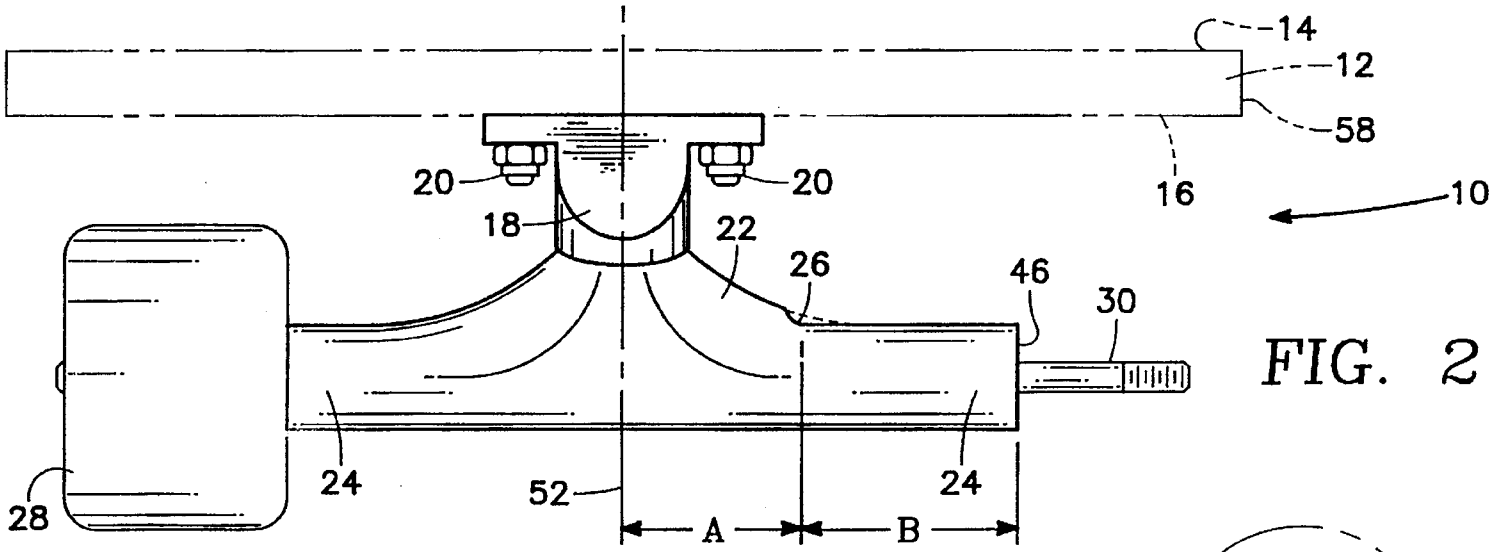
FIG. 2 is a front end view of the skateboard of FIG. 1 showing one of the conventional wheels of the skateboard being removed from the skateboard axle.
Figure 3:
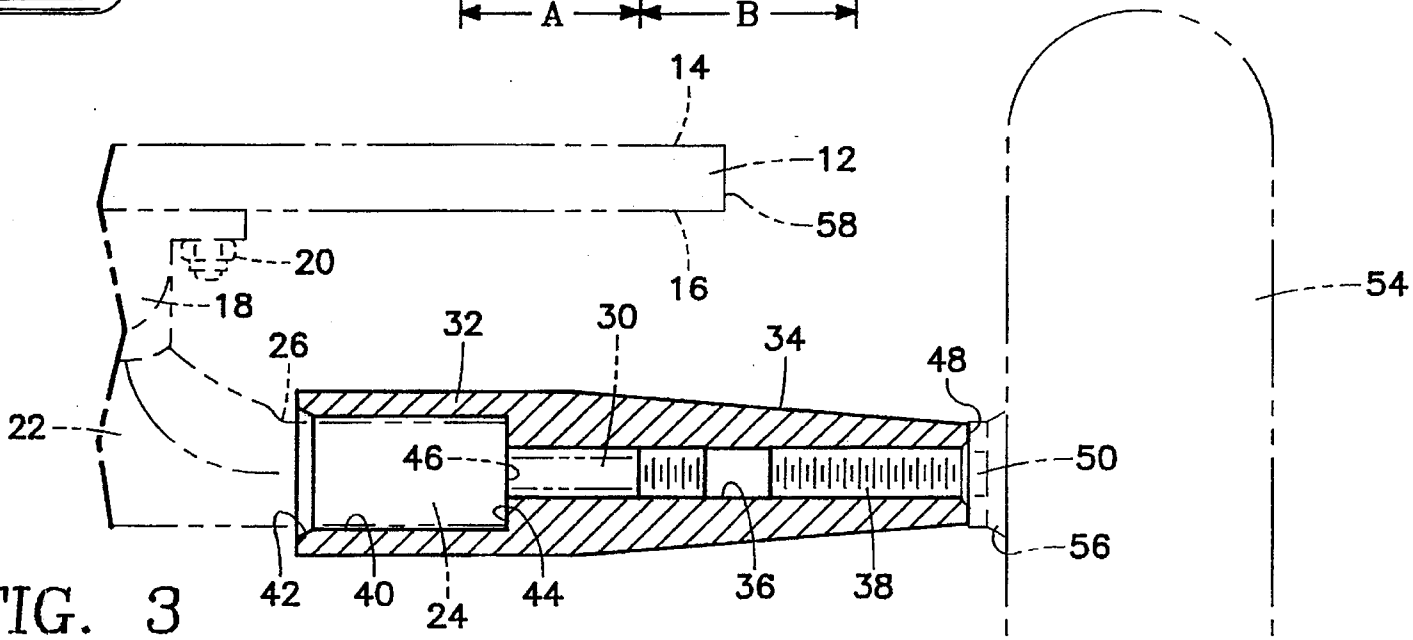
FIG. 3 is a cross-sectional view through one end of the skateboard axle showing the adapter in cross-section installed on the axle and the adapter connected to an oversized wheel.

Referring particularly to the drawings there is shown the skateboard 10 of this invention. Skateboard 10 is composed of a platform 12 which has an upper surface 14 which is defined as the operating plane and a bottom surface 16. The user of the skateboard 10 is to place his or her feet on the operating plane of the upper surface 14. Fixedly mounted to the bottom surface 16 are a pair of trucks 18. The trucks 18 are mounted to the platform 12 by means of conventional bolt fasteners 20. Each truck 18 defines a longitudinal center vertical axis 52. The trucks 18 are deemed to be conventional and form no specific part of this invention. An example of a type of truck 18 that could be used is what is disclosed within the U.S. Pat. No. 5,372,384 issued to a David R. Smith.

Connected to each truck 18 is an axle 22. The connection of the axle 22 to the truck 18 is at about the longitudinal center point of the axle 22. The axle 22 forms opposite ends with each end defining a cylindrical shaped section 24. It may be necessary in accordance with this invention to shave down (remove material) on the axle 22 in the area 26. The reason for this will be clarified further on in the specification.

The cylindrical shaped section 24 terminates in an end face 46. Centrally mounted within the end face 46 and protruding therefrom is a threaded shaft 30. Screw threadably mounted on the threaded shaft 30 and to be rotatably mounted thereon is a conventional skateboard wheel 28. Skateboard wheels 28 are to be removed from their shafts 30. The shaft 30 is then located within a through opening 36 of an adapter 32. Shaft 30 is to be tightened within the screw-threaded through opening 36 until the end face 46 abuts against flange 44 of an internal cavity 40. The cylindrical shaped section 24 is to fit in a close fitting manner within the internal cavity 40. Sliding entrance of the cylindrical shaped section 24 within the internal cavity 40 is facilitated by means of annular chamfer 42 which is formed within the body of the adapter 32. To have end face 46 abut against flange 44, it will be necessary to shave down the axle 22 in area 26 as previously mentioned.

In order to minimize the overall weight of the adapter 32, the outer section of the adapter 32 is tapered forming tapered surface 34. A wheel shaft 38 is tightly threadably secured within the screw-threaded through opening 36 in alignment with the threaded shaft 30. The wheel shaft 38 is secured to the hub 56 of a wheel 54 by means of a nut 50. The nut 50 tightly abuts against outer end surface 48 of the adapter 32.

It can thus be seen by using the adapter 32 of this invention that the overall wheel base of the skateboard has been expanded. This expansion is about 3.5 inches for each adapter 32. It is to be understood that the actual length of this expansion can be a matter of choice. The larger size wheels 54 can then be safely mounted in conjunction with each adapter 32 with these wheels 54 being spaced from the peripheral edge 58 of the platform 12. It should also be noted that part of the wheels 54 are located some distance above the operating plane of the upper surface 14.

The material utilized in construction of the axle is to be as light as possible in order to minimize weight. The heavier the weight of the skateboard 10, the less maneuverable the skateboard 10 will be. Therefore by using aluminum in the material of construction of the axle 22, the weight can be significantly decreased. However, aluminum is weaker than steel. in order to minimize the possibility of breakage of the axle 22, it is desirable to transfer the bending moment from the end face 46 to a position closer to the truck 18 which lowers the value of the bending moment and decreases the possibility of axle failure. By locating the cylindrical shaped section 24 in a close confining manner within internal cavity 40, the bending moment is substantially nearer the truck 18. The length of the cylindrical shaped section 24 to be about distance B with distance A representing the distance from longitudinal center axis 52 to the removed section 26. Generally it can be said that distance B is about equal to distance A which means that distance B is about twenty-five percent of the length of the axle 22. However, as long as distance B is within the range of twenty to forty percent of the length of the axle 22, it has been discovered that the possibility of breakage of the axle is substantially diminished.

One of the advantages to using the adapter 30 of this invention is that even though larger diameter wheels are used, such as eight inches, ten inches, twelve inches and sixteen inches, the overall center of gravity is still maintained as low as possible. Maintaining the center of gravity of the overall skateboard 10 as low as possible substantially increases stability of use of the skateboard 10. Using larger pneumatic wheels enables the user to travel over dirt, rocks, grassy slopes and almost any other type of off-road terrain. By using adapter 32, the method of steering the skateboard 10 is unchanged. Actually the steering is accentuated by the fact that the wheel base of the skateboard 10 has been substantially widened.

It is important to understand that if adapters were utilized that did not place the cylindrical shaped section 24 within an internal cavity 40, the axles 22 would almost invariably fail during usage. It is the function of the adapter 32 to minimize stress to the truck 18 by moving the point of bending moment to directly adjacent the widest portion of the axle 22. Also locating the bending moment closer to the longitudinal center axis 52 substantially eliminates the possibility of axle failure.

The main reason for using aluminum rather than steel in the axle 22 is that aluminum is 2.8 times lighter than steel. Also, utilization of aluminum in the adapters 32 further minimizes the increase in weight as opposed to if the adapters 32 were made from steel. The weight factor in the skateboard industry can mean the difference between success and failure. It is important to add as little weight as possible in conjunction with the skateboard 10.

Without the adapter 32 of this invention, each and every skateboard within the prior art must be purchased for a specific use and that skateboard is to be utilized only for that use. A good skateboard can cost upwards of $150. By utilizing the adapters 32 of the present invention, the single specific use skateboard can be modified to permit its use in multiple ways. Also, using of the skateboard 10 of the present invention on hard surfaces results in a skateboard that is as quiet to operate as a bicycle. Also, larger pneumatic rubber tires 54 make the skateboard 10 move faster, more responsive and safer than conventional skateboards.

It is estimated that one of the main marketing locations for the skateboard 10 of the present invention would be at the ski slope during the off season. This would enable ski resort operators to operate year round. Utilizing of the skateboards 10 of this invention, the skateboards 10 would be able to be used in the same manner as skis in that the users and skateboards 10 could be carried up the mountain by a lift line or chair lift, hop off the lift line or chair lift and then moved down the mountain or hill on the skateboard 10.

Also, the skateboard 10 of the present invention would be a perfect training device for snowboarders during the off season. A pair of trucks which includes the adapters 32 of the present invention and enlarged size wheels 54 would be mounted directly on the undersurface of the snowboard.

During the snow season, these trucks would be removed and the mounting holes on the undersurface of the snowboard would be filled by an appropriate filler which would then permit the snowboard to again be used on snow.

What is claimed is:

1. In combination with a skateboard, said skateboard having an elongated platform, said elongated platform having a peripheral edge, said elongated platform having a top surface and a bottom surface, said top surface having an operating plane, a human adapted to stand on said operating plane, a pair of trucks fixedly mounted on said bottom surface, said trucks located in a spaced apart arrangement, each said truck having an axle, each said axle terminating in a pair of opposite ends, each said opposite end having an exterior cylindrical surface, each said exterior cylindrical surface being within the range of twenty to forty percent of the total length of said axle, each said opposite end having a threaded shaft, an adapter mounted on each said threaded shaft with there being a separate adapter for each said threaded shaft, said adapter being constructed of a rigid material, each said adapter comprising:

an elongated body having an internal screw-threaded through opening, said elongated body extending beyond said peripheral edge of said elongated platform, said elongated body having an internal cavity, said internal screw-threaded through opening connecting with said internal cavity, said threaded shaft being threadably secured with said internal screw-threaded opening, said exterior cylindrical surface being matingly located within said internal cavity; and a wheel having a threaded wheel axle, said threaded wheel axle being threadably secured within said screw-threaded through opening, a portion of said wheel being located above said operating plane.

2. The combination as defined in claim 1 wherein:

said rigid material comprising aluminum.

3. The combination as defined in claim 1 wherein:

said internal cavity terminating at an inner wall, said exterior cylindrical surface tightly abutting against said inner wall thereby fixedly connecting said adapter to said axle.

* * * * *